United States Patent [19]

Yoneyama

[11] Patent Number: 4,635,941

[45] **Date of Patent: * Jan. 13, 1987**

[54] GOLF CLUB HEAD

[75] Inventor: Minoru Yoneyama, Niigata, Japan

[73] Assignee: Yonex Kabushiki Kaisha, Niigata, Japan

[ * ] Notice: The portion of the term of this patent subsequent to Aug. 13, 2002 has been disclaimed.

[21] Appl. No.: 712,231

[22] Filed: Mar. 15, 1985

[51] Int. Cl.[4] ..... A63B 53/04

[52] U.S. Cl. ..... 273/78; 273/167 A; 273/167 J; 273/DIG. 23

[58] Field of Search ..... 273/DIG. 23, 167 D, 273/167 R, 167 F, 167 H, 167 J, 167 E, 175, DIG. 7

[56] References Cited

U.S. PATENT DOCUMENTS

| | | | |
|---|---|---|---|
| 2,530,446 | 11/1950 | Beardsley . | |
| 3,025,061 | 3/1958 | Ernst et al. | 273/DIG. 7 |
| 3,220,733 | 11/1965 | Saleeby . | |
| 4,506,888 | 3/1985 | Nardozzi, Jr. . | |
| 4,534,558 | 8/1985 | Yoneyama | 273/DIG. 23 |

FOREIGN PATENT DOCUMENTS

| | | | |
|---|---|---|---|
| 692197 | 8/1964 | Canada | 273/167 R |

OTHER PUBLICATIONS

Yonex, "Carbonex 22", *Golf Digest,* 12/83, issue, p. 47.

*Primary Examiner*—Richard C. Pinkham
*Assistant Examiner*—Stuart W. Rose
*Attorney, Agent, or Firm*—Wenderoth, Lind & Ponack

[57] ABSTRACT

A golf club head includes a sole of metal material, an inner head member integral with the sole and having a substantially triangular shape in cross section, a hosel for receiving a shaft, and an outer head member formed of carbon fiber reinforced resin material and having a substantially inverted V-shaped cross-sectional configuration covering the entirety of the inner head member. Lower ends of the outer head member are in close contact with shoulders formed between the sole and the lower end of the inner head member, and marginal edges of such lower ends are flush with the sole. The joint between the inner and outer head members is strengthened by elements formed on the outer surface of the inner head member.

2 Claims, 4 Drawing Figures

GOLF CLUB HEAD

BACKGROUND OF THE INVENTION

The present invention relates to the head structure of golf clubs and, more particularly, to an improvement in the head structure of iron clubs.

In general, iron clubs are intended primarily for second, third and bunker shots rather than tee shots, and they are used often for hitting shots from the bare ground, a sandy place and so on as well as from turf. Accordingly, conventional iron clubs are designed so that the club head is made in one body from a metallic material such as soft iron, stainless steel or the like in order to prevent the club head, and in particular its sole, from being readily damaged by a pebble or sand when hitting a ball.

In the design of such a club head, it is regarded as preferable in terms of function to add weight to the toe, the heel and the sole of the club head and to lessen the weight of the hitting region of the clubface. From this point of view, the hitting region is usually formed thin, but this results in the defect of decreased hitting distance of a ball hit by such a club. Further, the hitting region of the clubface is made of a hard metal, and hence its repulsive force is small. Accordingly, the use of hard metal is not always preferable from the viewpoints of the direction and distance of the ball.

SUMMARY OF THE INVENTION

It is therefore an object of the present invention to provide a head structure of iron clubs, the hitting region of which is made of a material of relatively large repulsive force for achieving greater distance and more stable direction of a ball hit by such club.

Another object of the present invention is to provide a golf club head which can improve "feel" of shots.

A further object of the present invention is the provision of a golf club head which is so tough as to prevent damage thereto when it is used to hit a ball on bare ground or in a bunker.

A still further object of the present invention is to provide a golf club head which may be so designed as to have a desired weight and balance without spoiling various functions required in golf play.

According to the present invention, a golf club head includes a sole formed of metal material and an inner head member of metal material formed integrally with the sole, the inner head member extending upwardly from the sole and having a substantially triangular shape in cross section, a lower end thereof having a thickness in a direction of swing of the head smaller than that of the sole to provide front and rear shoulders therebetween. A hosel is provided to receive a shaft therein and is formed of metal material integrally with the sole and the inner head member, the hosel being connected to the sole and the inner head member at a heel portion of the golf club head. An outer head member is formed of carbon fiber reinforced resin material and has a substantially inverted V-shaped cross-sectional configuration covering the entirety of the inner head member, lower ends of the outer head member being in close contact with the shoulders with marginal edges of the lower ends being flush with the sole. Also provided is a means for strengthening the joint between the inner and outer head members, which means is formed on the outer surface of the inner head member.

The means for strengthening the joint may comprise a plurality of dimples or, alternatively, a plurality of grooves, in which the carbon fiber reinforced resin material is in close fit. The means may also comprise a plurality of small protuberances or a plurality of ribs in the form of straight lines, the carbon fiber reinforced material being fitted thereon.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
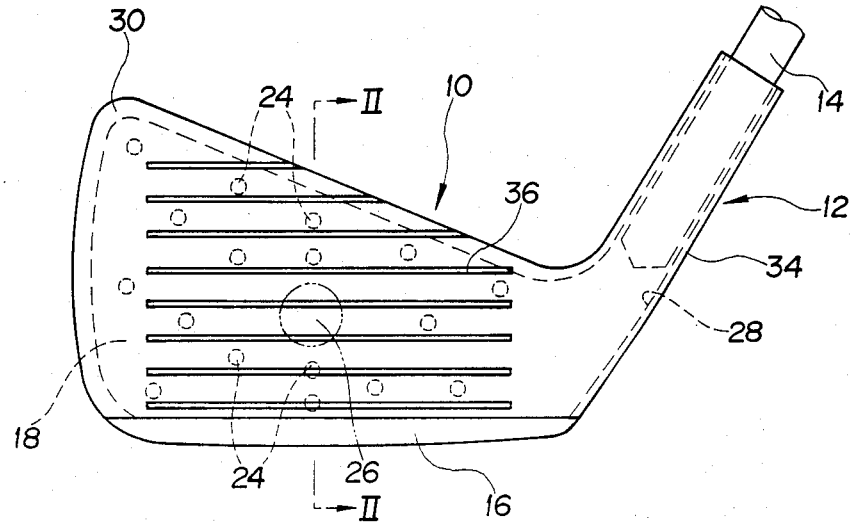
FIG. 1 is a front elevational view illustrating a golf club head according to a first embodiment of the present invention.
Figure 2:
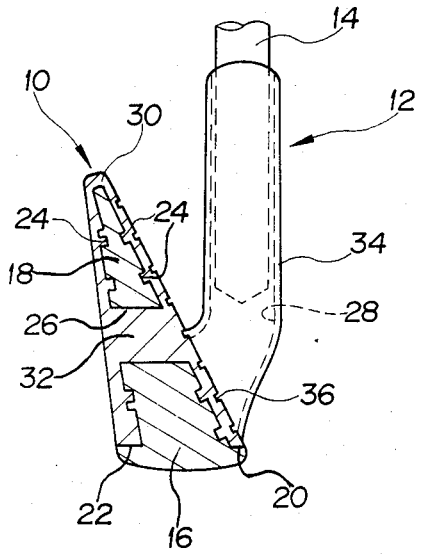
FIG. 2 is a sectional view of the golf club head taken along the line II—II in FIG. 1.

Referring to FIGS. 1 and 2 of the drawings, a golf club head according to a first embodiment is illustrated to have a frontal contour similar to those of conventional iron club heads and comprises a head body 10 and a hosel 12. The hosel 12 is a tubular socket for receiving a shaft 14 therein. The head body 10 includes a sole 16 formed of metal material such as soft iron, stainless steel, brass or like material, and an inner head member 18 of the same material and formed integrally with the sole 16. The inner head member 18 extends upwardly from the sole 16 and has a substantially triangular shape in cross section as shown in FIG. 2. The thickness of the lower end of the member 18 in the direction of swing of the head is smaller than that of the sole 16, so that a front shoulder 20 and a rear shoulder 22 are provided between the sole 16 and the member 18. Formed on an outer surface of the inner member 18 are a plurality of dimples 24 each having a relatively small diameter for increasing the superficial area of the member 18. A relatively large hole 26 may be provided through the member 18 at substantially a central portion thereof. The hosel 12 preferably includes an inner tube 28 which is formed of the metal material and is integral with the sole 16 and the member 18 at a heel portion of the head body 10.

The entire part of the inner member 18 is covered with an outer head member 30 formed of carbon fiber reinforced resin material. As shown in FIG. 2, the outer head member 30 has a substantially inverted V-shaped configuration in cross section to cover the front and rear surfaces of the inner member 18. When shaping the outer head member 30 over the inner member 18, the dimples 24 are filled with the reinforced resin material whereby a joint between the metal portion 18 and the resin portion 30 is increased due to the increased area of the joint the tight fit of the resin material into the dimples 24. The joint is further strengthened by a bridge 32 of the resin material filling the hole 26 to connect the front and rear portions of the outer member 30.

The lower ends of the outer head member 30 are in close contact with the shoulders 20 and 22 in such a manner that the marginal edges of the lower ends of the member 30 are flush with the sole 16. In the embodiment illustrated the outer member 30 is provided with a tubular extension 34 extending from the heel portion of the head body 10 to cover the entirety of the inner tube 28 for completing the hosel 12. Thus, the metal material is visual only at the sole 16. A plurality of grooves 36 are formed on the front surface of the outer member 30 to define a hitting area.

The outer head member 30 is a laminated molding of plural sheets, preferably about 20 sheets, of long carbon fiber which is suitably woven and impregnated with thermosetting resin material such as epoxy resin. The outer member 30 is formed into the illustrated shape by heat-hardening the sheets placed over the inner member 18 and the inner tube 28 and packed in the hole 26. The amount of carbon fiber is preferably about 30 to 75 wt. % based on the total amount of the material forming the outer member 30 and, more preferably, about 50 to 70 wt %.

The outer head member 30 formed of the carbon fiber reinforced resin material gives the hitting area a larger repulsive force and higher elasticity than those obtainable with conventional iron clubs, thereby increasing the hitting distance of a golf ball. Further, the surface of the hitting area is less hard than conventional surfaces and, when hitting the ball, it is somewhat compressed so that its contact area and time of contact with the ball will increase, thus directing the ball in a stable direction. The sole 16 is made of metal as is the case with conventional iron clubs, and hence is not likely to be damaged by pebbles, sand or the like, for example, when hitting a shot from bare ground. The inner member 18 provides suitable weight and stiffness to the head body 10. The joint between the inner and outer members 18 and 30 is strengthened by the dimples 24 as described above, and, if desired, the dimples 24 may be replaced by or may be formed together with small protuberances for increasing the joint. The dimples and/or protuberances may be formed on the inner member 18 at random or in a predetermined manner so as to obtain a desired weight and balance of the head. Provision of the hole 26 also contributes to a so-called toe-heel balance which is believed to be advantageous because it enlarges the sweet spot.

In the illustrated embodiment, since the hosel 12 on which the largest stress is imposed when hitting a ball is also covered with the carbon fiber reinforced resin material, the hosel 12 is physically strengthened. This permits the reduction of the thickness of the metal inner tube 28 to increase the flexibility between it and the head body for achieving a greater hitting distance of the ball.

Figure 3:
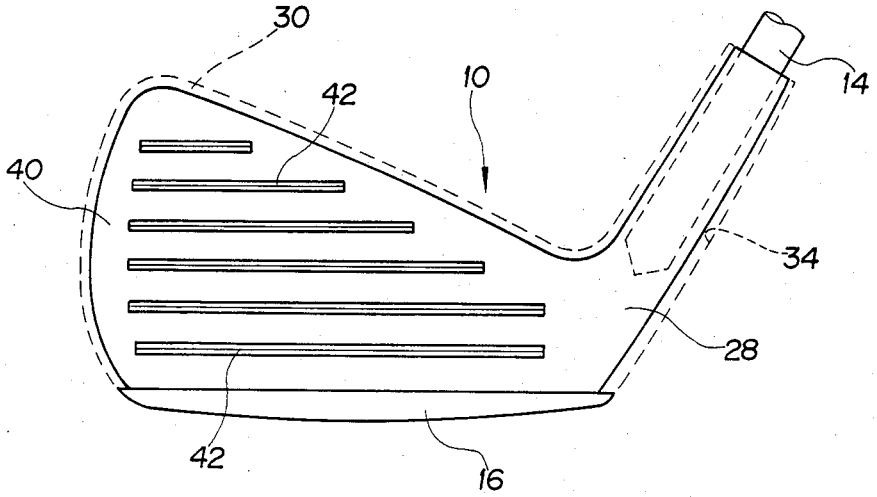
FIG. 3 is a front elevation of a golf club head according to a second embodiment of the present invention, with an outer head member being removed for the purpose of facility of illustration.
Figure 4:
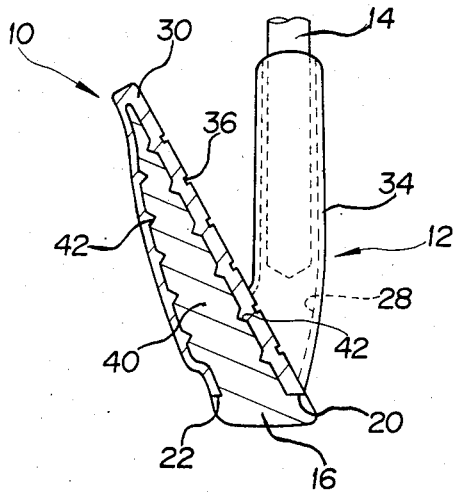
FIG. 4 is a sectional view of the golf club head of the second embodiment.

A golf club head according to a second embodiment of the invention is illustrated in FIGS. 3. and 4 in which the same reference numerals are used to designate portions the same as or corresponding to those of the first embodiment. In this second embodiment, an inner head member 40 is provided at its outer surface with a plurality of grooves 42 which are for example in the form of notches and preferably extend laterally between the toe and heel portions of the head. The inner head member 40 is covered with the carbon fiber reinforced resin material forming the outer member 30, with the grooves being filled with such material to thereby strengthen the joint between the inner and outer members 30 and 40. Instead of or together with the grooves 42 a rib in the form of straight line may be provided on the outer surface of the member 40. However, the grooves as in the illustrated embodiment are preferable because they may facilitate the formation of the grooves 36 on the outer head member 30, the latter grooves being formed during the heat-hardening of the reinforced resin material with use of a die which has lateral ribs to be adjusted in position above the grooves 42. In this connection, the number of the grooves 42 is preferably greater than that of the lateral grooves 36 to be formed.

Although the present invention has been described with reference to the preferred embodiments thereof, many modifications and alterations may be made within the spirit of the invention.

What is claimed is:

1. A golf club head comprising:

a sole formed of metal material;

an inner head member of metal material formed integrally with said sole, said inner head member extending upwardly from said sole and having a substantially triangular shape in cross section, a lower end of said inner head member having a thickness in a direction of swing of the head smaller than the thickness of said sole to provide front and rear shoulders therebetween;

a hosel for receiving a shaft therein and formed of metal material integrally with said sole and said inner head member, said hosel being integral with said sole and said inner head member at a heel portion of the golf club head;

an outer head member formed of carbon fiber reinforced resin material, said outer head member having a substantially inverted V-shaped cross sectional configuration covering the entirety of said inner head member, lower ends of said outer head member being in close contact with said shoulders with marginal edges of said lower ends being flush with said sole; and a means for strengthening the joint between said inner and outer head members, said means comprising a hole and a plurality of dimples formed in said inner head member, said hole being formed at substantially a central portion of said inner head member and extending therethrough from front to back thereof, said dimples being formed all around the outer surface of said inner head member, said carbon fiber reinforced resin material of said outer head member filling said hole and being in close fit in said dimples.

2. A golf club head as claimed in claim 1, wherein said outer head member includes an integral tubular extension covering the entirety of said hosel.

* * * * *